US010883335B2

(12) United States Patent
Goff

(10) Patent No.: US 10,883,335 B2
(45) Date of Patent: Jan. 5, 2021

(54) HOLDDOWN ASSEMBLY

(71) Applicant: Malcolm Goff, Rosemary (CA)

(72) Inventor: Malcolm Goff, Rosemary (CA)

( * ) Notice: Subject to any disclaimer, the term of this patent is extended or adjusted under 35 U.S.C. 154(b) by 276 days.

(21) Appl. No.: 15/898,995

(22) Filed: Feb. 19, 2018

(65) Prior Publication Data

US 2018/0238138 A1 Aug. 23, 2018

Related U.S. Application Data

(60) Provisional application No. 62/460,301, filed on Feb. 17, 2017.

(51) Int. Cl.
*E21B 33/129* (2006.01)
*E21B 43/12* (2006.01)
*E21B 23/01* (2006.01)

(52) U.S. Cl.
CPC ..... *E21B 33/1293* (2013.01); *E21B 23/01* (2013.01); *E21B 43/126* (2013.01); *E21B 43/127* (2013.01)

(58) Field of Classification Search
CPC .. E21B 33/12; E21B 33/1293; E21B 33/1291; E21B 33/1295; E21B 43/126; E21B 43/127; E21B 23/01; E21B 23/02; E21B 23/03; E21B 23/04; E21B 23/08; E21B 23/06; E21B 17/1071
See application file for complete search history.

(56) References Cited

U.S. PATENT DOCUMENTS 1,496,698 A * 6/1924 Wolfe ..... E21B 33/126 277/332
1,719,582 A * 7/1929 Blakely ..... E21B 33/12 417/450
1,983,489 A * 12/1934 Penrod ..... F04B 53/16 166/188
2,054,322 A * 9/1936 Hoferer ..... E21B 23/02 166/136
2,080,736 A * 5/1937 Nixon ..... E21B 33/126 277/335
2,216,336 A * 10/1940 Barnes ..... F16J 15/184 277/337
2,799,348 A * 7/1957 Page ..... E21B 33/134 166/212

* cited by examiner

*Primary Examiner* — David Carroll
(74) *Attorney, Agent, or Firm* — Parlee McLaws LLP; Chi Fai Andrew Lau

(57) ABSTRACT

A holddown assembly is provided for axially securing a pump in a wellbore. The assembly has a mandrel having at least one resilient holding element and at least one resilient sealing element. The holding elements are made of a durable material and configured to require a pre-determined seating force to seat the assembly in a seating tubular, and a pre-determined unseating force to unseat the assembly. The holding elements are configured to elastically deform when seated, such that the pre-determined seating and unseating force does not change significantly even over many seating/unseating cycles. The sealing elements are configured to sealingly engage with the seating tubular to prevent wellbore fluid from flowing thereby. As the sealing elements are only used for forming a fluid seal, and not for securing the pump, damage to the sealing elements as a result of repeated seatings and unseatings is mitigated.

19 Claims, 8 Drawing Sheets

HOLDDOWN ASSEMBLY

CROSS-REFERENCE TO RELATED APPLICATIONS

This application claims the benefit of U.S. Provisional Patent application Ser. No. 62/460,301, filed Feb. 17, 2017, the entirety of which is incorporated herein by reference.

FIELD

Embodiments herein relate to sucker rod pump assemblies in oil and gas wells. In particular, embodiments herein relate to a holddown assembly for anchoring a downhole pump in wellbore tubing.

BACKGROUND

In oil and gas production, reciprocating pumps are positioned downhole within a tubing string situated in a wellbore, and actuated by a sucker rod string connected to a pumpjack at surface to produce hydrocarbons to surface. It is common to use insertable downhole pumps; as they may be inserted through the tubing string to a desired position in the wellbore as opposed to inserted into the wellbore with the tubing string, and do not necessitate the retrieval of the tubing string when the pump must be removed. A seating tubular, such as a seating nipple or a segment of the tubing string, can be located at a desired position along the tubing string to receive the pump. The seating tubular can have a bore with a complementary profile to the pump such that the pump cannot be run downhole beyond the tubular.

Downhole pumps typically comprise a barrel that is releasably anchored in the seating tubular and a plunger that reciprocates within the barrel to produce hydrocarbons to surface. The pump barrel is removably secured in the seating tubular by a holddown assembly to prevent axial or longitudinal movement thereof during operation of the pump. As shown in FIGS. 1A and 1B, conventional holddown assemblies are usually threaded onto, and can be located above or below, the pump and comprise one or more sealing elements, such as packer cups, to engage with the inner bore wall of the seating tubular. When the holddown assembly is seated, the packer cups form a sealing engagement with the inner bore wall of the seating tubular to prevent production fluid from flowing thereby back into the wellbore, and also to engage the inner wall of the tubing string with sufficient force to prevent axial movement of the pump barrel during operation. The pump may be unseated from the seating tubular and retrieved to surface by applying sufficient axial force to overcome the frictional force between the packer cups and the bore wall of the seating tubular.

The use of packer cups or other sealing elements to both seal and anchor the pump is problematic, as materials best suited for holding down the pump are typically not materials conducive to sealing, and vice versa. For example, the relatively soft materials suitable for fluidly sealing with the seating tubular result in sealing elements that survive only two to three seatings before they must be replaced, due to the substantial amount of holding force that must be exerted by the sealing elements on the bore wall of the seating tubular bore to axially secure the pump barrel. When sealing cups are used, the cups may be flipped to the wrong direction when pulled out, which can severely damage the cups. Furthermore, the holding force of the sealing elements decreases after each seating of the holddown assembly due to wear. As such, operators typically only have two or three attempts to seat the pump before the packers must be replaced, with each failed seating attempt significantly reducing the lifespan and holding force of the sealing elements. It is possible that even the initial seating of the pump can result in failure of the sealing elements.

Manufacturing the sealing elements from ore durable materials presents its own problems, as such sealing elements are less effective in creating a sealing engagement with the seating tubular bore, potentially resulting in leakage of production fluid back into the wellbore.

There is a need for a holddown assembly that can be used for multiple seatings without requiring replacement of sealing elements, does not lose holding force over repeated seating/unseating cycles, and can be tailored for use in various wellbore conditions.

SUMMARY

A holddown assembly is provided for seating in a seating tubular located along a tubing string to axially secure a pump in the tubing string, comprising a mandrel having at least one holding element and at least one sealing element retained thereon. The at least one holding element is made of a resilient, durable, long-lasting material and sized to be slightly larger than the bore of the seating tubular, such that a pre-determined axial seating force must be applied in order to deform the at least one holding element and seat the holddown assembly in the seating tubular. Similarly, a pre-determined axial unseating force must be applied in order to overcome the frictional force between the at least one holding element and the bore wall of the seating tubular and unseat the holddown assembly. The at least one holding element is preferably sized and configured to only elastically deform when seated in the seating tubular, such that the pre-determined seating and unseating force of the holding element does not change significantly even over many seating/unseating cycles. The at least one sealing element is made of a resilient material that is softer than that of the at least one holding element and is configured to sealingly engage with the bore wall of the seating tubular and prevent wellbore fluid from flowing thereby. As the at least one sealing element is only used for forming a fluid seal, and not for axially securing the pump barrel during production operations, damage to the sealing element as a result of repeated seatings and unseatings is mitigated.

The holding and sealing elements can be retained on the mandrel between first and second radial shoulders. In embodiments, at least one of the shoulders is removable, such as comprising part of a removable end retainer or coupler, such that the holding and sealing elements can be easily installed or removed from the mandrel. The holding elements can be secured against axial movement, such as with a retaining member coupled to an intermediate connection of the mandrel located between the first and second shoulders, such that the holding elements are sandwiched between the first shoulder and retaining member. The sealing elements can be slidably retained on the mandrel between the retaining member and second shoulder.

In a broad aspect, a holddown assembly for removably seating in a seating tubular having a bore with an inner diameter can comprise a mandrel having a pump connection at a first end; at least one holding element retained on the mandrel; and at least one sealing element retained on the mandrel; wherein the at least one holding element is made of a first resilient material and has a diameter greater than the inner diameter of the seating tubular bore; and wherein the at least one sealing element is made of a second resilient material softer than the first resilient material and is configured to sealingly engage with the seating tubular bore.

In an embodiment, the mandrel further comprises a mandrel bore extending axially therethrough.

In an embodiment, the at least one holding element is configured to require a pre-determined seating force to seat in the wellbore tubular, and a pre-determined unseating force to unseat the holddown assembly from the wellbore tubular.

In an embodiment, the at least one holding element is configured to only deform elastically when seated in the seating tubular.

In an embodiment, the at least one holding element is made of steel.

In an embodiment, the at least one holding element is made of a hardened copper nickel tin alloy.

In an embodiment, an outer diameter of the at least one holding element is in the range of 0.003" to 0.025" greater than the inner diameter of the seating tubular bore.

In an embodiment, the at least one holding element and at least one sealing element are retained on the mandrel between a first radial shoulder located towards the first end of the mandrel, and a second radial shoulder located towards a second end of the mandrel.

In an embodiment, the at least one holding element is secured against axial movement between the first shoulder and a third shoulder of a generally ring-shaped retaining member removably secured to an intermediate connection on the mandrel located between the first and second shoulders.

In an embodiment, the at least one sealing element is retained on the mandrel between a fourth shoulder of the retaining member and the second shoulder.

In an embodiment, at least one of the first and second shoulders are removably coupled to the mandrel.

In an embodiment, the first shoulder is integral with the mandrel and the second shoulder is located at a proximal end of a removable end retainer configured to couple with a second connection located at a second end of the mandrel.

In an embodiment, the removable end retainer is a coupler configured to couple with a downhole component.

In an embodiment, the at least one sealing element is slidably retained on the mandrel.

In an embodiment, the at least one holding element is fixed to the mandrel.

In another broad aspect, a method of seating a holddown assembly in a bore of a seating tubular located in a wellbore can comprise connecting the holddown assembly to a rod string; running the holddown assembly into the wellbore to the seating tubular; and applying at least a pre-determined threshold force in a downhole direction to seat the holddown assembly in the seating tubular.

In an embodiment, the step of running the holddown assembly into the wellbore to the seating tubular further comprises sealingly engaging at least one sealing element of the holddown assembly with the bore of the seating tubular.

In an embodiment, the method of seating a holddown assembly can further comprise applying at least the pre-determined threshold force in an uphole direction to unseat the holddown assembly from the seating tubular; and withdrawing the holddown assembly to surface.

In an embodiment, the method of seating a holddown assembly can further comprise selecting an at least one holding element of the holddown assembly to provide the pre-determined threshold force.

In another broad aspect, a method of assembling a holddown assembly comprises axially sliding one or more holding elements onto a mandrel; coupling a retaining member with an intermediate connection of the mandrel to axially secure the one or more holding elements between a first shoulder of the mandrel and a third shoulder of the retaining member; axially sliding one or more sealing elements onto the mandrel; and coupling an end retainer with a second connection of the mandrel to slidably retain the one or more sealing elements between a fourth shoulder of the retaining member and a second shoulder of the end retainer.

DESCRIPTION

Figures 1A, 1B:
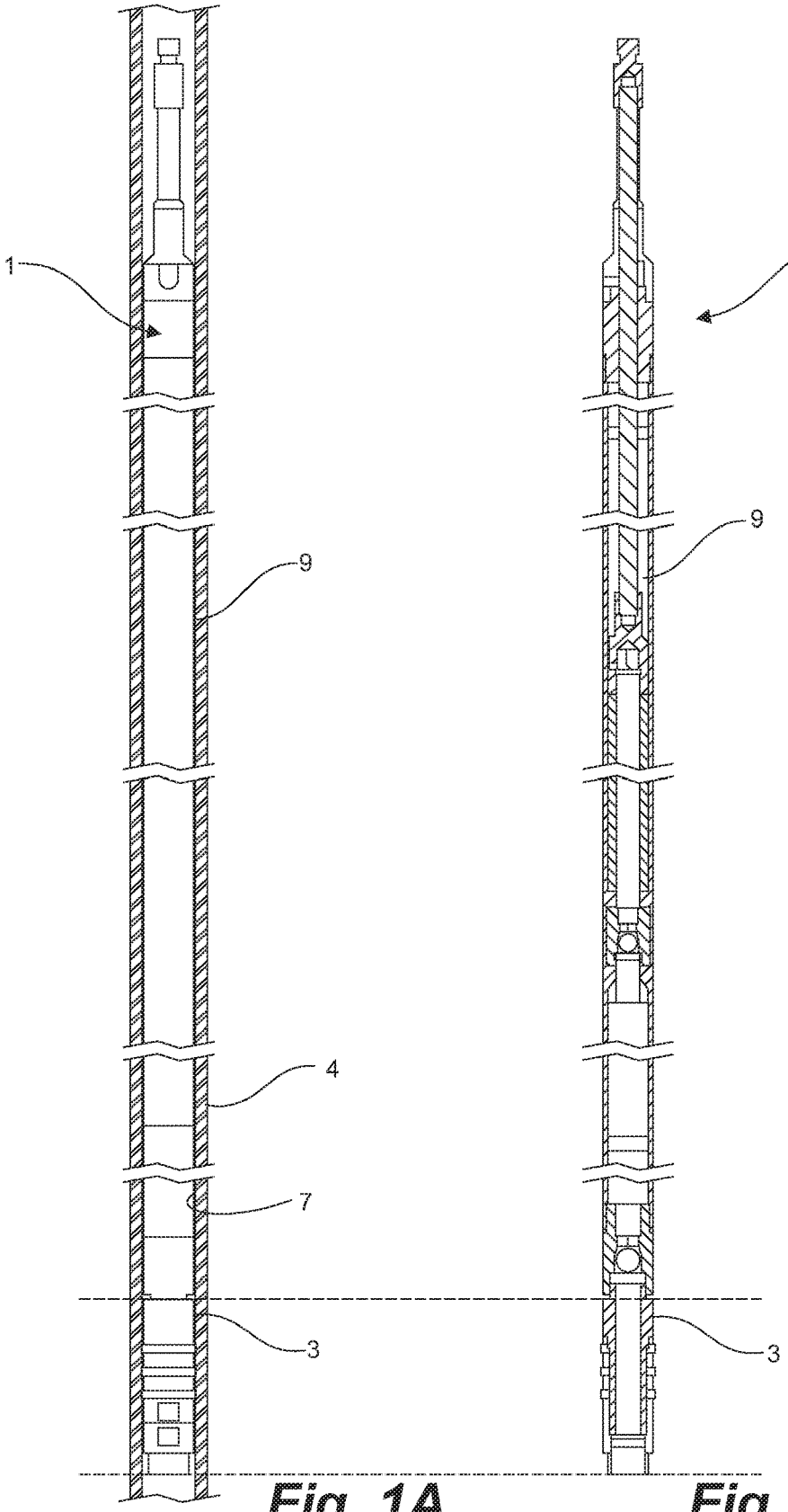
Fig. 1A PRIOR ART
Fig. 1B PRIOR ART
FIG. 1A is a side view of a prior art holddown assembly connected to a pump and rod string.
FIG. 1B is a side cross-sectional view of the prior art holddown assembly of FIG. 1A.

With reference to FIGS. 1A and 1B, prior art holddown assemblies 1 employ one or more sealing elements 3, such as packer cups, for engaging with the inner bore wall 7 of a seating tubular 4, such as a seating nipple or section of tubing string, to prevent axial movement of the pump barrel 9 during operation and fluidly seal the annular space between the holddown assembly and bore wall 7 of the seating tubular 4 to prevent production fluid from flowing thereby. Hydrostatic loading engages the sealing elements to the inner surface 7 of the seating tubular 4.

With reference to FIGS. 2A, 2B, 3B and 3C, an improved holddown assembly 10 is provided for anchoring a downhole pump 2, comprising a mandrel 12, first end 16, a second end 18, and a pump connection 20 located adjacent the first end 16 for connecting to the pump 2 (FIG. 2B), such as to the standing valve and/or barrel. One or more holding elements 30 and one or more sealing elements 32 can be retained on the mandrel 12. The holddown assembly 10 can be configured to connect to the top or to the bottom of the pump 2.

Herein, terms such as "upper", "lower", "top", "bottom", and the like are used for convenience, although the orientation of the holddown assembly 10 is not necessarily vertical. Pumps and holddown assemblies can also be oriented such that their axes are at an angle to the true vertical axis.

Figure 3A:
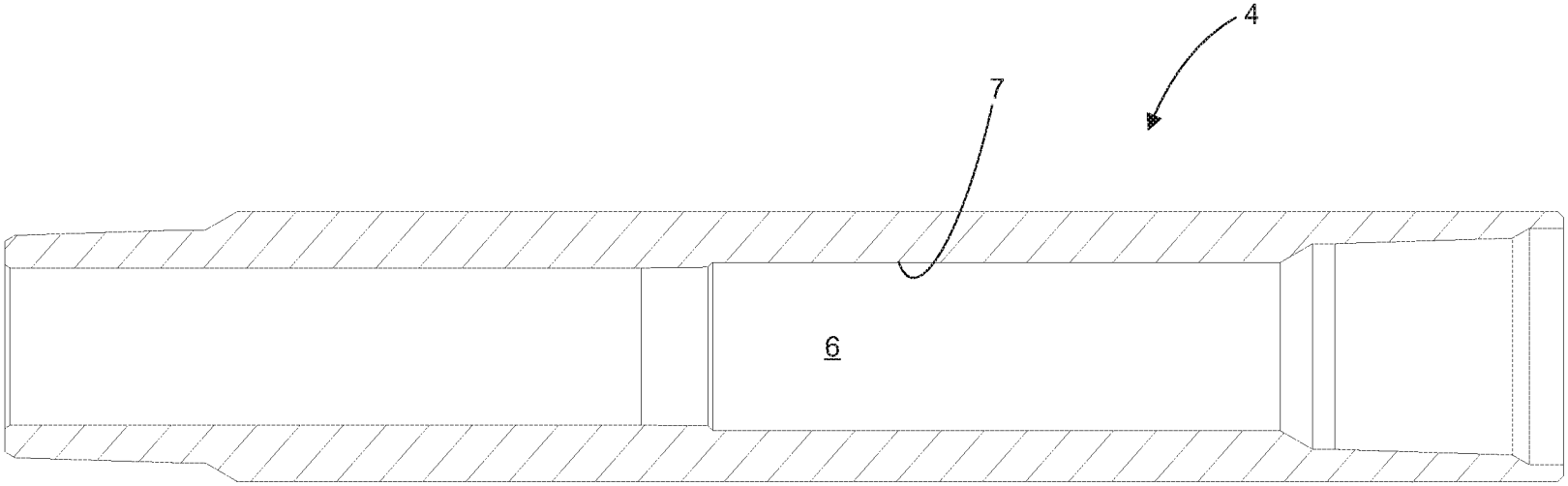
FIG. 3A is a side cross-sectional view of an embodiment of a seating tubular.
Figure 3B:
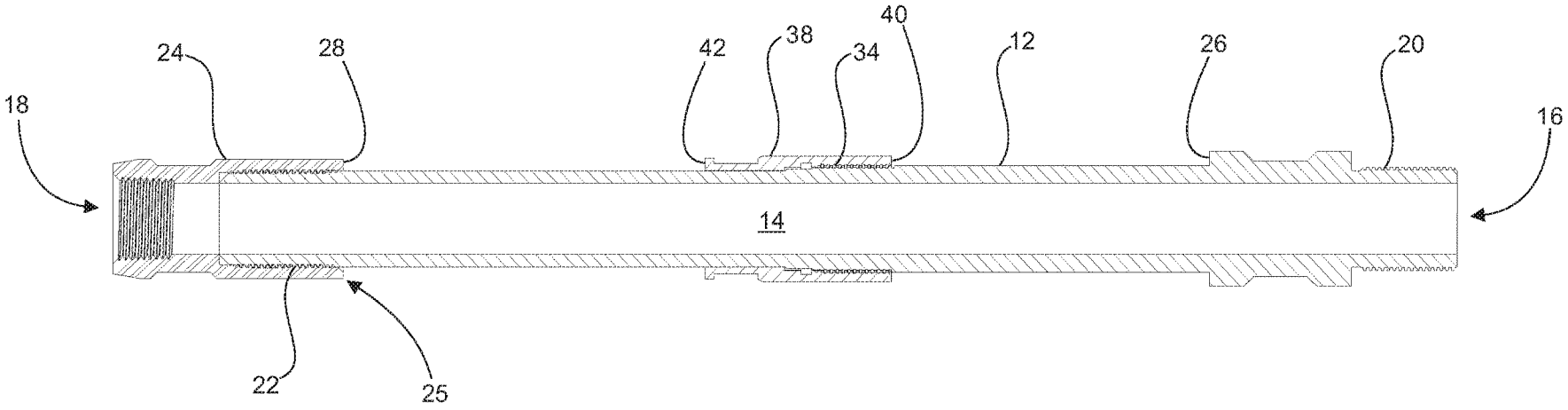
FIG. 3B is a side cross-sectional view of the holddown assembly of FIG. 2 with the holding elements and sealing elements removed.

In detail, with reference to FIG. 3B, the mandrel 12 of the holddown assembly 10 is a generally cylindrical member configured to be inserted into the bore 6 of a corresponding seating tubular 4, best seen in FIG. 3A, located along a tubing string. A mandrel bore 14 can extend axially through the mandrel 12, such as to permit fluid communication between the wellbore and pump 2. A first radial shoulder 26 and a second radial shoulder 28 can be located towards a first end 16 and second end 18 of the mandrel 12, respectively, for axially retaining one or more holding elements 30 and one or more sealing elements 32 therebetween. In preferred embodiments, at least one of the first and second shoulders 26,28 is removable for convenient installation and/or removal of holding elements 30 and sealing elements 32 from the mandrel 12.

Figure 2A:
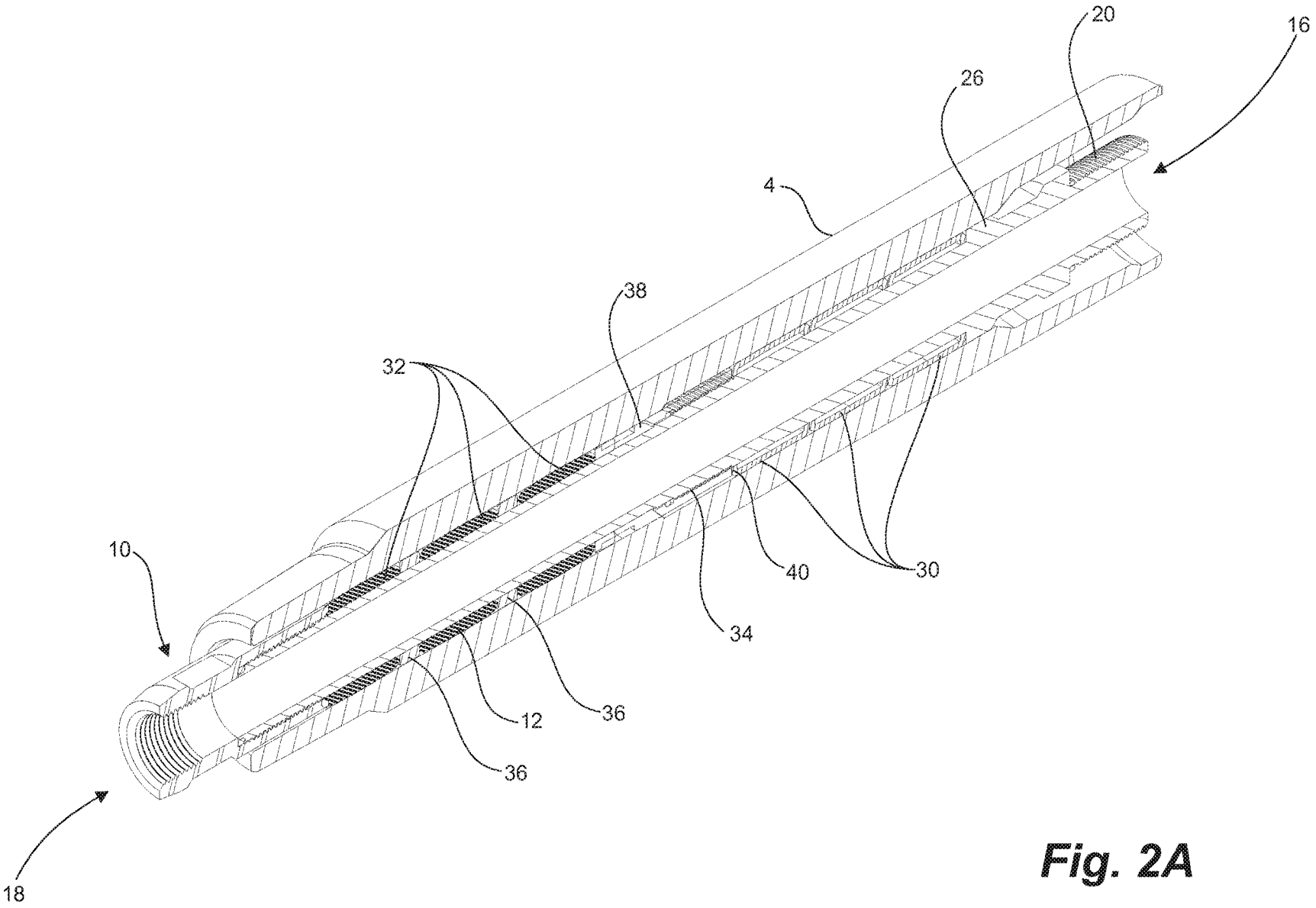
FIG. 2A is a perspective cross-sectional view of an improved holddown assembly seated in a seating tubular according to one embodiment.
Figure 2B:
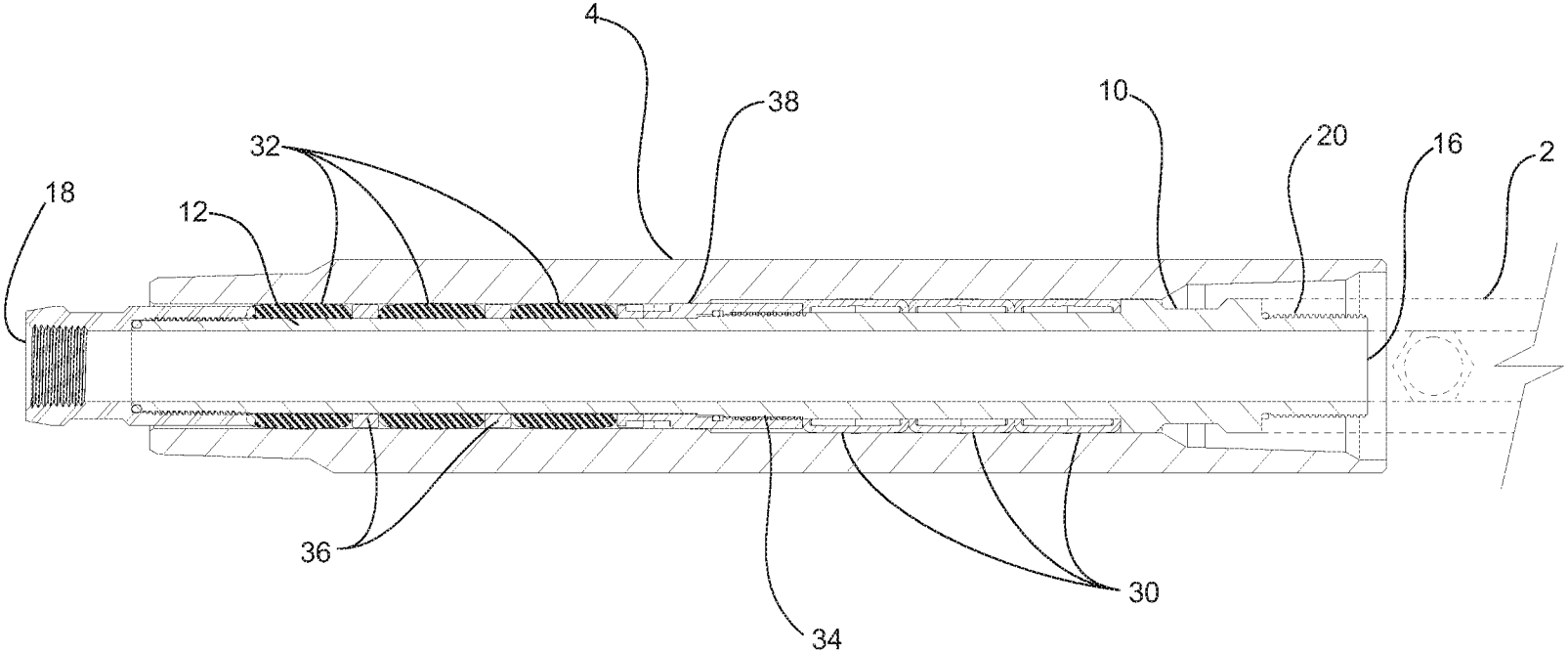
FIG. 2B is a side cross-sectional view of the holddown assembly of FIG. 2A connected to the downhole end of a pump.
Figure 4A:
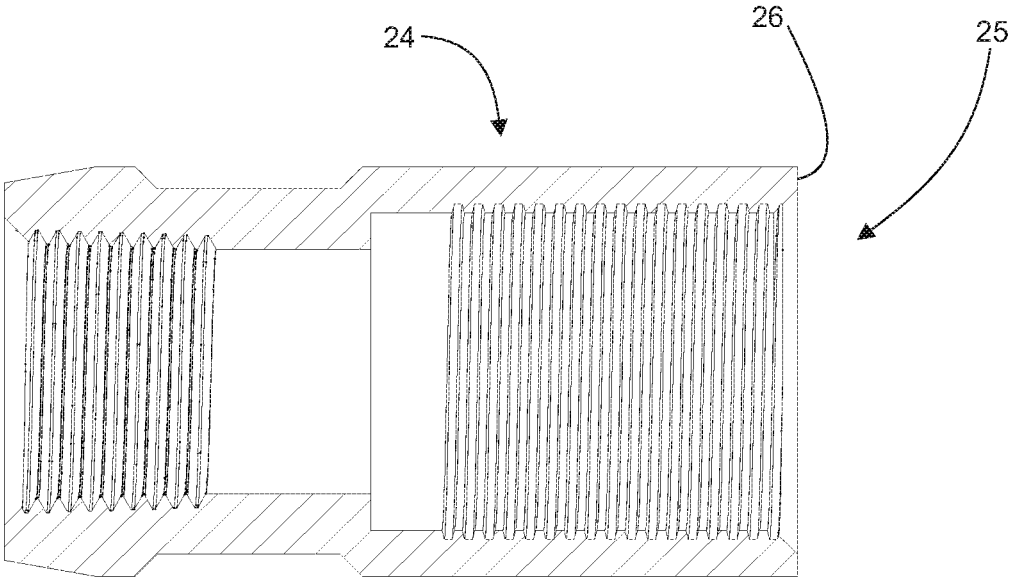
FIG. 4A is a side cross-sectional view of an end retainer/coupler of the holddown assembly of FIG. 2A.

As best shown in FIG. 2B, pump connection 20, such as a threaded connection, is located adjacent the first end 16 of the mandrel 12 for coupling to the pump 2 either directly or indirectly, such as via a threaded adapter. In an embodiment, with reference to FIGS. 3B and 4A, a second connection 22, such as a threaded connection (FIG. 3B), can be located adjacent the second end 18 for connecting the mandrel 12 to a generally ring-shaped or tubular removable end retainer 24 having the second shoulder 28 formed at a proximal end 25 thereof (FIG. 4A). In embodiments, the end retainer 24 can be a coupler configured to connect directly or indirectly to components such as a dip tube or tailpipe.

As mentioned above, with reference to FIGS. 2A, 2B and 3C, one or more resilient holding elements 30 are located on the mandrel 12. In an uncompressed state, the holding elements 30 have an outer diameter greater than the inner diameter of the bore 6 of the seating tubular 4 such that a pre-determined axial threshold seating force is required to radially compress or deflect the outer diameters of the holding elements 30 inwardly to force the holddown assembly 10 into the seating tubular 4 and seat it therein. Additionally, a pre-determined axial threshold unseating force is required to overcome the frictional force between the holding elements 30 and seating tubular bore wall 7 and unseat the holddown assembly 10 therefrom. The threshold seating and unseating forces can be generally the same. The holding elements 30 can be tapered or rounded toward their axial ends to facilitate seating and unseating, and substantially hollow or otherwise shaped to allow the elements 30 to deflect radially inwards when the threshold seating force is applied to the holding assembly 10. In preferred embodiments, the holding elements 30 are axially secured on the mandrel to limit axial play, provide a more consistent threshold seating and unseating force, and avoid crushing the one or more sealing elements 32. For example, with reference to FIG. 4B, a locking ring or other retaining member 38 can be coupled to an intermediate connection 34, such as a threaded connection, on the mandrel 12. A third shoulder 40 of the retaining member 38 can abut the holding elements 30 to secure them between the third shoulder 40 and the first shoulder 26. A fourth shoulder 42 of the retaining member 38 located opposite the third shoulder 40 can retain the sealing elements 32 between the fourth shoulder 42 and the second shoulder 28. Alternatively, the holding elements 30 can also be fixed to the mandrel 12 via welding or other means known in the art. In such embodiments, first shoulder 26 and retaining member 38 can be omitted, as they are not necessary for retaining and/or axially securing the holding elements 30, and the sealing elements 32 can be retained between the holding elements 30 and second shoulder 28.

In a preferred embodiment, the holding elements 30 are sized, shaped, and made of a resilient, long-lasting material so as to only elastically deform when engaged with the seating tubular 4, and return to its original state when disengaged, thereby maintaining substantially the same required axial seating/unseating force even after many seating/unseating cycles. In the embodiment depicted in FIGS. 2A, 2B, and 3C, the holding elements 30 are elastically compressible rings having a generally outer half-toroidal shape, formed of ToughMet® 3 hardened copper nickel tin alloy, and have a diameter that is about 0.007" greater than the diameter of the seating tubular bore 6. An axial force of about 6000 lbs per holding element 30 is required to seat or unseat the holddown assembly 10. The number of holding elements 30 can be increased or decreased to adjust the required seating/unseating force. In other embodiments, the holding rings 30 can be made of steel or any other durable, resilient material that is suitable for the conditions in which the holddown assembly 10 will be used, and can have a diameter of about 0.003" to 0.025" greater than the bore diameter of a corresponding seating tubular 4.

Figure 3C:
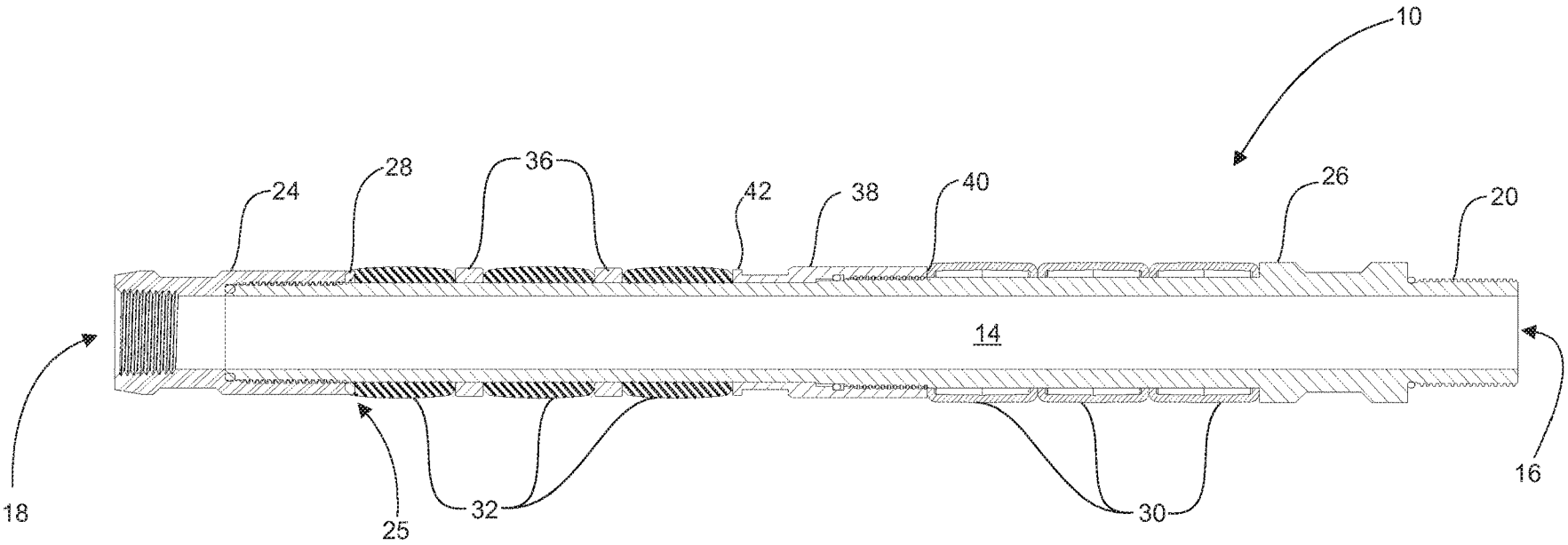
FIG. 3C is a side cross-sectional view of the holddown assembly of FIG. 2 with the holding elements and sealing elements retained on the mandrel of the assembly.
Figure 4B:
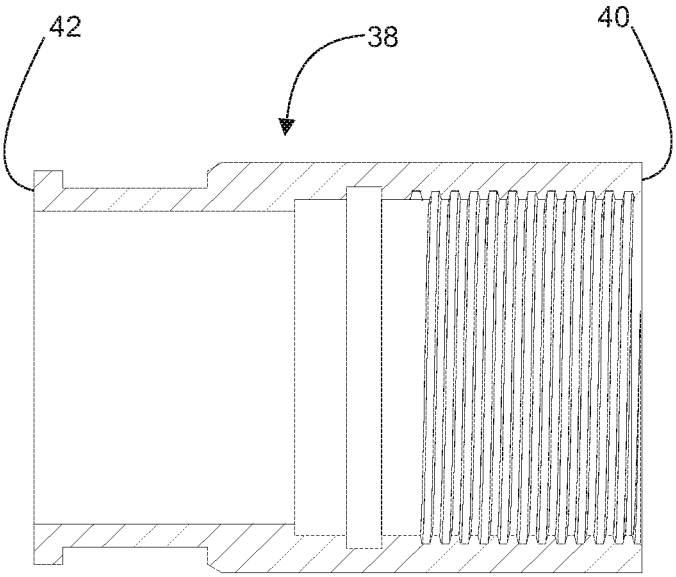
FIG. 4B is a side cross-sectional view of a retaining member of the holddown assembly of FIG. 2A.

As shown in FIGS. 2A, 2B, and 3C, one or more sealing elements 32 are also located on the mandrel 12. In the depicted embodiment, the sealing elements 32 are elastomeric rings located about the mandrel 12. In a preferred embodiment, sealing elements 32 are free to slide axially about the mandrel 12 so as to better form a sealing engagement with the seating tubular bore wall 7 when axially loaded. As the sealing elements 32 are slidably mounted on the mandrel 12, pressure from the fluid column in the annular space between the holddown assembly 10 and sealing tubular 4 axially compresses the sealing elements 32 together, causing the sealing elements 32 to expand radially outwards against the bore wall 7 of the seating tubular 4 and increasing the sealing force therebetween.

Sealing elements 32 can be made of a resilient material suitable for forming a fluid seal with the bore wall 7 of the seating tubular 4. As the sealing elements 32 are not required to secure the holddown assembly 10 from axial movement, the elements 32 can be made of a softer material than that of the holding elements 30. For example, the sealing elements 32 can comprise hydrogenated nitrile 85 durometer o-rings, which are suitable for performance sealing in most wellbore applications. However, other sealing elements can be used as conditions require. In some embodiments, as depicted in FIGS. 2A, 2B, and 3C, spacers 36 can be located between adjacent sealing elements 32 to provide a solid surface for the sealing elements 32 to work against.

In the depicted embodiment, the sealing elements 32 are located downhole from the holding elements 30. If a retaining member 38 is used to axially secure the holding elements 30, the sealing elements 32 can be located on the opposite side of the retaining member 38 from the holding elements 30. In other embodiments, the sealing elements 32 can be located uphole from the holding elements 30, arranged alternatingly therewith, or arranged in another order.

In the embodiment depicted in FIGS. 2A, 28, 3B, and 3C, the holddown assembly 10 is assembled by first installing the holding elements 30 onto the mandrel 12 by sliding them thereon from the second end 18 to the first end 16 until the uppermost holding element 30 abuts the first shoulder 26, and subsequent elements 30 abut one another. Retaining member 38 can then be threaded onto the corresponding threaded intermediate connection 34 of the mandrel 12 until the third shoulder 40 of the retaining member 38 abuts the bottommost holding element 30, thereby securing the holding elements 30 between the third shoulder 40 of retaining member 38 and the first shoulder 26. The sealing elements 32 and spacers 36 can then be slid onto the mandrel 12 from the second end 18 towards the first end 16. Finally, the coupling 24 can be threaded onto the second connection 22 of the mandrel 12 to retain the sealing elements 32 on the mandrel 12 between the second shoulder 28 of the coupling 24 and the fourth shoulder 42 of the retaining member 38. Of course, other orders of assembly could be performed, as would be understood by a person of skill in the art.

Figure 5A:
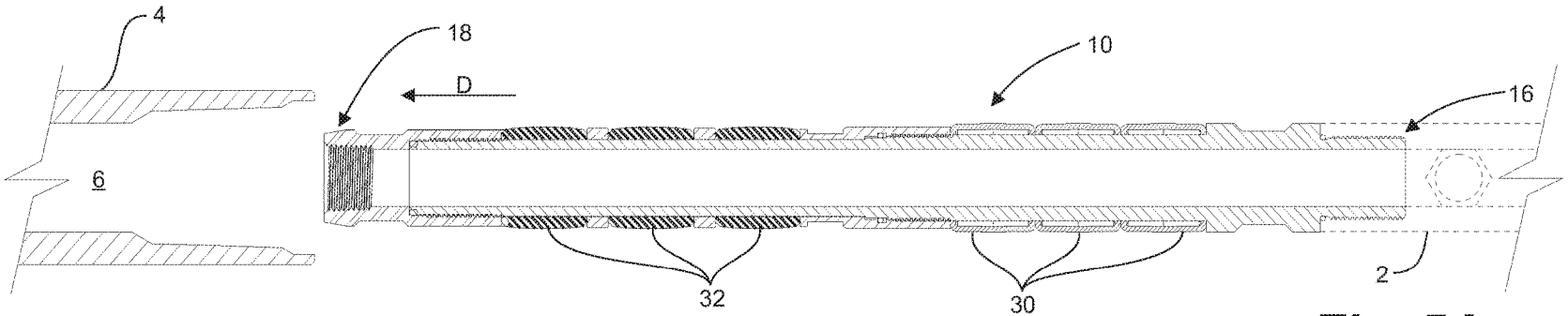
FIG. 5A is a side cross-sectional view of an embodiment of a holddown assembly being inserted into a seating tubular.
Figure 5B:
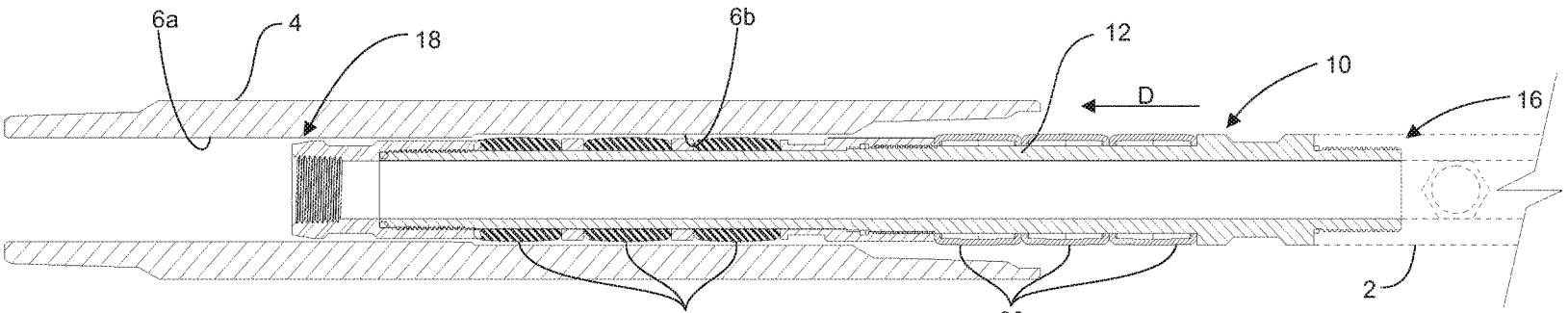
FIG. 5B is a side cross-sectional view of the holddown assembly of FIG. 5A wherein the sealing elements of the holddown assembly are sealingly engaged with the bore wall of the seating tubular.
Figure 5C:
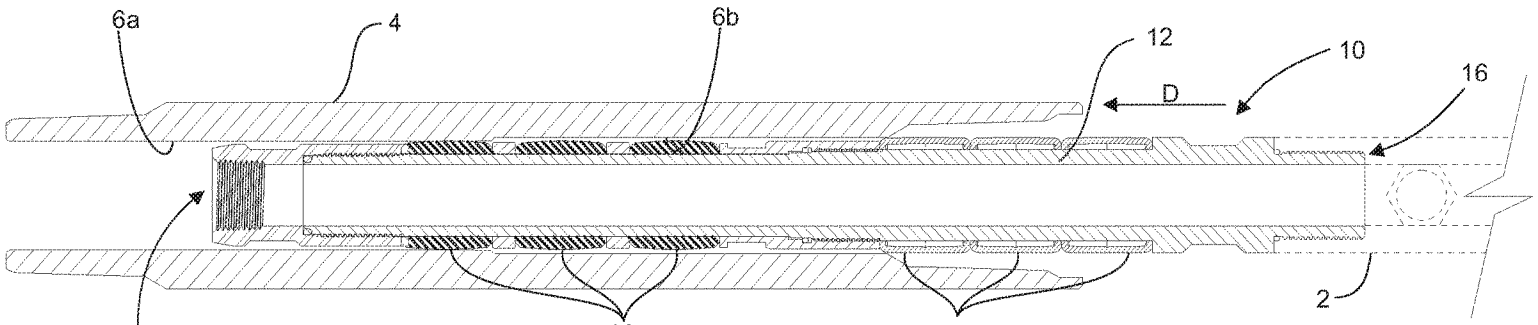
FIG. 5C is a side cross-sectional view of the holddown assembly of FIG. 5A wherein the holding elements of the holddown assembly are engaged with the bore wall of the seating tubular to seat the assembly therein.

In use, in an embodiment and with reference to FIG. 5A, the first end 16 of the mandrel 12 is connected directly or indirectly to pump 2. A dip tube or tailpipe can be connected to the coupler 24 located at the second end 18 of the mandrel 12 to establish fluid communication between the pump 2 and the bottom of the production zone when the holddown assembly 10 is seated. The pump 2 and holddown assembly 10 can then be lowered with a rod string into a tubing string in the wellbore in direction D towards seating tubular 4. In the depicted embodiment, the bore 6 of the seating tubular 4 has a profile complementary to holddown assembly 10 such that the assembly cannot be run downhole beyond the tubular. Specifically, bore 6 comprises a downhole narrower portion 6*a* and a uphole wider portion 6*b*. As shown in FIG. 5B, as the holddown assembly 10 approaches the seating tubular 4, sealing elements 32 first sealingly engage the wall of the narrower bore portion 6*a*. Turning to FIG. 5C, as the holddown assembly 10 travels further downhole, the holding elements 30, which have a slightly greater diameter than that of the wider bore portion 6*b*, reach the wider portion 6*b* and resistance is encountered due to the interference fit. To seat the holddown assembly 10 in the seating tubular 6, the pre-determined seating force can be applied to the assembly 10 in the downhole direction to sufficiently deform the holding elements 30 to fit within the wider bore portion 6*b*. Typically, the weight of the rod string, which is usually over 20,000 lbs, is sufficient to provide the requisite axial force to seat the holddown assembly 10. The holddown assembly 10 can continue to be lowered in direction D until the lowermost holding element 30 reaches the narrower bore portion 6*a*, at which point the assembly 10 can proceed no further and is thereby seated in the seating tubular 4. The holding elements 30 are frictionally engaged with the seating tubular bore 6 to axially secure the pump 2 in the wellbore. To unseat the holddown assembly 10, the rod string is pulled upwards until sufficient axial force is applied to the holddown assembly 10 to disengage the holding elements 30 from the bore wall 7 of the seating tubular 4.

As the holddown force is substantially provided by the holding elements 30, the holddown assembly 10 can be seated and unseated many times without damaging the sealing elements 32. The resilient holding elements 30 are capable of withstanding many seating/unseating cycles with little to no decrease in the force required to seat and/or unseat the assembly 10. As a result, the need to retrieve the holddown assembly 10 to surface for replacement of sealing or holding elements 32,30 is significantly reduced.

In an alternative embodiment of the holddown assembly 10, first and second shoulders 26,28 are not removable, and the holding elements 30 can each be axially bisected into first and second portions, which can be combined over the mandrel 12, such as by welding, to retain the elements 30 therearound. Likewise, the sealing elements 32 can each comprise first and second portions which can be combined over the mandrel 12 such as by fusing, welding, or other joining methods known in the art.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof.

I claim:

1. A holddown assembly for removably seating in a seating tubular having a bore with an inner diameter, comprising:

a mandrel having a pump connection at a first end;

two or more axially adjacent holding elements retained on the mandrel; and one or more sealing elements, retained on the mandrel and spaced axially from the two or more holding elements therealong;

wherein the two or more holding elements are made of a first resilient material and have an outer diameter greater than the inner diameter of the seating tubular bore for frictionally engaging a bore wall of the seating tubular bore; and wherein the one or more sealing elements are made of a second resilient material softer than the first resilient material and are configured to sealingly engage with the seating tubular bore.

2. The holddown assembly of claim 1, wherein the mandrel further comprises a mandrel bore extending axially therethrough.

3. The holddown assembly of claim 1, wherein the two or more holding elements are configured to require the pre-determined seating force for seating in the tubular bore and a pre-determined unseating force to unseat the two or more holding elements therefrom.

4. The holddown assembly of claim 1, wherein the two or more holding elements are configured to only deform elastically for seating in the seating tubular bore.

5. The holddown assembly of claim 1, wherein the two or more holding elements are made of steel.

6. The holddown assembly of claim 1, wherein the two or more holding elements are made of a hardened copper nickel tin alloy.

7. The holddown assembly of claim 1, wherein the outer diameters of the two or more holding elements are in the range of 0.003" to 0.025" greater than the inner diameter of the seating tubular bore.

8. The holddown assembly of claim 1, wherein the two or more holding elements and one or more sealing elements are retained on the mandrel between a first radial shoulder located towards the first end of the mandrel, and a second radial shoulder located towards a second end of the mandrel.

9. The holddown assembly of claim 8, wherein the two or more holding elements are secured against axial movement between the first shoulder and a third shoulder of a generally ring-shaped retaining member removably secured to an intermediate connection on the mandrel located between the first and second shoulders.

10. The holddown assembly of claim 9, wherein the one or more sealing elements are retained on the mandrel between a fourth shoulder of the retaining member and the second shoulder.

11. The holddown assembly of claim 8, wherein at least one of the first and second shoulders are removably coupled to the mandrel.

12. The holddown assembly of claim 11, wherein the first shoulder is integral with the mandrel and the second shoulder is located at a proximal end of a removable end retainer configured to couple with a second connection located at a second end of the mandrel.

13. The holddown assembly of claim 12, wherein the removable end retainer is a coupler configured to couple with a downhole component.

14. The holddown assembly of claim 1, wherein the one or more sealing elements are slidably retained on the mandrel.

15. The holddown assembly of claim 1, wherein the two or more holding elements are fixed to the mandrel.

16. A method of seating a holddown assembly having two or more axially adjacent holding elements and one or more sealing elements axially spaced from the two or more holding elements thereon in a bore of a seating tubular located in a wellbore, the two or more holding elements made of a first resilient material and having an outer diameter greater than an inner diameter of the seating tubular, comprising:

connecting the holddown assembly to a rod string;

running the holddown assembly into the wellbore to the seating tubular;

applying at least a pre-determined threshold force in a downhole direction for elastically deforming the two or more holding elements for seating in the bore of the seating tubular and frictionally engaging a bore wall in the seating tubular when seated therein.

17. The method of claim 16, wherein the step of running the holddown assembly into the wellbore to the seating tubular further comprises sealingly engaging the one or more sealing elements of the holddown assembly with the bore of the seating tubular.

18. The method of claim 16, further comprising:

applying at least the pre-determined threshold force in an uphole direction to unseat the two or more holding elements from frictional engagement with the bore wall of the seating tubular; and withdrawing the holddown assembly therefrom to surface.

19. A method of assembling a holddown assembly, comprising:

axially sliding one two or more holding elements onto a mandrel such that each holding element of the two or more holding elements is axially adjacent to at least one other holding element of the two or more holding elements;

coupling a retaining member with an intermediate connection of the mandrel to axially secure the two or more holding elements between a first shoulder of the mandrel and a third shoulder of the retaining member;

axially sliding one or more sealing elements onto the mandrel; and coupling an end retainer with a second connection of the mandrel to slidably retain the one or more sealing elements between a fourth shoulder of the retaining member and a second shoulder of the end retainer, wherein the one or more holding elements are configured to elastically deform under a predetermined force for frictional engagement with a wall of a bore of a seating tubular when seated therein in use.

* * * * *